US006447115B1

(12) United States Patent
Gallagher et al.

(10) Patent No.: US 6,447,115 B1
(45) Date of Patent: Sep. 10, 2002

(54) DIVE MASK WITH INTEGRATED MONITORING SYSTEM

(75) Inventors: Dennis Gallagher; William Olstad; Charles Holmes, all of Panama City; William Hughes, Lynn Haven, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/041,989

(22) Filed: Jan. 7, 2002

(51) Int. Cl.[7] ..... G02C 1/00
(52) U.S. Cl. ..... 351/43; 351/158
(58) Field of Search ..... 381/43, 41, 158; 2/426, 428; 340/676; 377/24.2, 5

(56) References Cited

U.S. PATENT DOCUMENTS 5,191,317 A * 3/1993 Toth et al. ..... 340/676
5,404,385 A * 4/1995 Ben-Haim ..... 351/158

* cited by examiner

*Primary Examiner*—Hung Xuan Dang
(74) *Attorney, Agent, or Firm*—Harvey A. Gilbert; Donald G. Peck

(57) ABSTRACT

A dive mask display system integrates a plurality of components in the mask's frame. These components can include: a radio frequency (RF) antenna for receiving RF signals indicative of dive information, a display that is directly viewable in a peripheral vision area of the diver but outside of the field of view defined by the mask's lens(es), a diver-controlled controller, and a depth sensor. The various monitored information, as well as bottom time tracked by the controller, can be displayed simultaneously.

20 Claims, 1 Drawing Sheet

DIVE MASK WITH INTEGRATED MONITORING SYSTEM

ORIGIN of the Invention

The invention described herein was made in the performance of official duties by a employees of the Department of the Navy and may be manufactured, used, licensed by or for the Government for any governmental purpose without payment of any royalties thereon.

FIELD OF THE INVENTION

The invention relates generally to dive masks, and more particularly to dive mask that integrates a display and its control system for supplying dive information to the display.

BACKGROUND OF THE INVENTION

For obvious reasons, a scuba diver must be aware of certain critical information such as the diver's depth, the status of his breathing apparatus, and the total time of the dive. Typically, the diver is supplied with a number of timers, pressure gauges and/or other displays for monitoring critical information. These timers/gauges/displays are either wrist-worn devices, mounted on a console that the diver wears/carries, or are placed/attached to the diver's face mask. The problem with wrist-worn or console-type devices is that the diver may not be able to see or access the devices because of tasks involving the use of both of the diver's hands (e.g., operating cameras, sonar devices, navigation or other data logging device, etc.). Further, if visibility in the water is poor, the diver may not even be able to see the device.

For these reasons, it is preferred for critical dive information to be made available at the diver's face mask as is the case in U.S. Pat. Nos. 5,033,818 and 5,764,203. However, in each of these display systems, the ultimate display occupies some portion of the diver's field of view. Furthermore, U.S. Pat. No. 5,033,818 relies on multiple reflections of display information within the face mask before the display information can be viewed by the diver. This means that the device's alignment is critical to proper functioning of the device. Such alignment could be compromised during use or general handling of the face mask. An additional concern with U.S. Pat. No. 5,764,203 is that this device is mounted to the face mask thereby making the face mask more cumbersome while the device itself is more susceptible to damage during both use and general handling thereof.

SUMMARY OF THE INVENTION

Accordingly, it is an object of the present invention to provide a dive mask that integrates a system for monitoring critical dive information.

Another object of the present invention is to provide a dive mask and integral dive information monitoring system that provides the diver with an unobstructed field of view while simultaneously making the dive information viewable within the dive mask regardless of visibility conditions.

Still another object of the present invention is to provide a dive mask having an integral dive information monitoring system that is well protected during both the use and handling of the dive mask.

Still another object of the present invention is to provide a dive mask having an integral dive information monitoring system that requires no cable connections thereto.

Other objects and advantages of the present invention will become more obvious hereinafter in the specification and drawings.

In accordance with the present invention, a dive mask display system is provided for use in monitoring dive information. A dive mask has at least one lens defining a field of view and a frame supporting the lens. The frame will interface with the face of a diver. A plurality of components are integrated in the frame. These components include: a radio frequency (RF) antenna for receiving RF signals indicative of dive information, a display that is directly viewable in a peripheral vision area of the diver but outside of the field of view defined by the lens, a controller coupled to the RF antenna and display for processing the RF signals in accordance with predetermined programming options to generate an output, and an input device coupled to the controller for selecting one of the predetermined programming options. The output associated with the selected programming option is passed to the display for the visual presentation thereof. The controller can further be used to track bottom time for the diver. A depth sensor can be embedded in the frame to monitor the diver's depth. The various monitored information can be displayed simultaneously.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
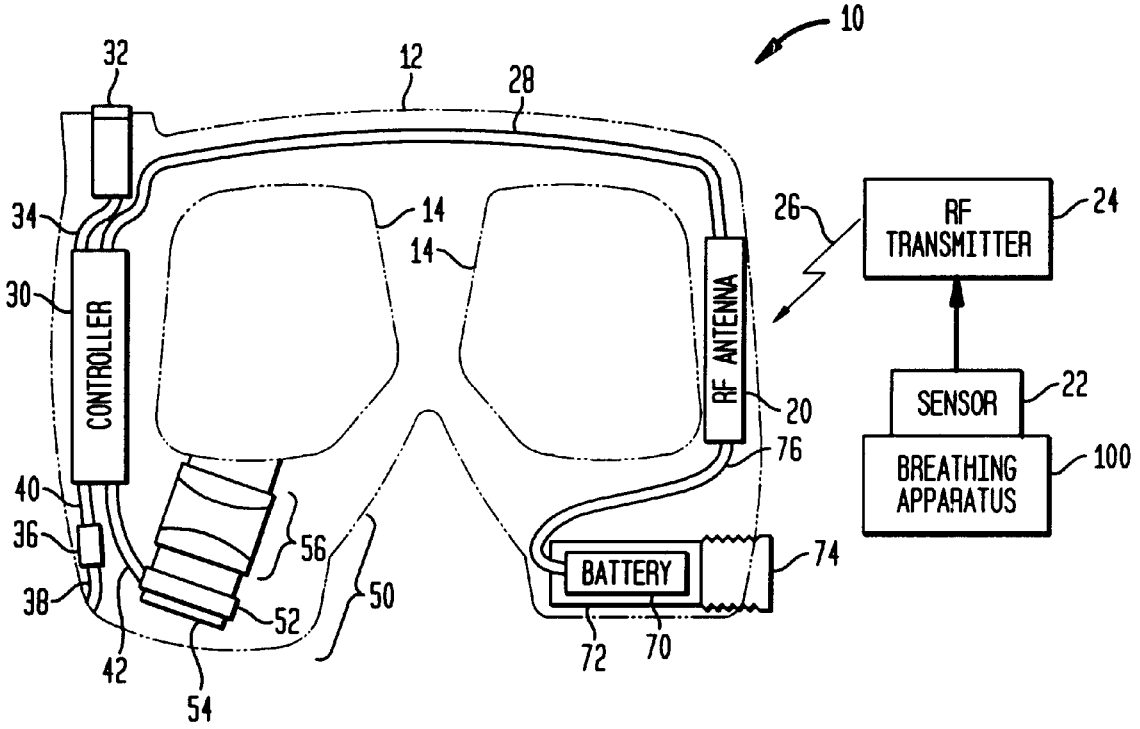
FIG. 1 is a plan view of a dive mask that integrates a dive information monitoring system in accordance with the present invention with the mask's lens and frame shown in phantom fashion to reveal the dive information monitoring system components.

Referring now to the drawings, and more particularly to FIG. 1, a plan view of one embodiment of the dive mask of the present invention is shown and referenced generally by numeral 10. The structural features of dive mask 10 are shown in phantom line fashion so that the dive information monitoring components can be clearly illustrated. Specifically, the relevant structural features of dive mask 10 shown in phantom line fashion are the mask's frame 12 and the lenses 14 through which a diver gazes. Note that a single lens could also be used without departing from the scope of the present invention. As is known in the art of dive mask design, frame 12 forms the interface or seal with the diver's face. The interface or sealing aspect of frame 12 is not part of the present invention and will, therefore, not be described herein.

Distributed about and within frame 12 are a plurality of components used to display critical dive information to the diver wearing dive mask 10. Construction of frame 12 having cavities and passages needed to house the components can be accomplished via well-known molding techniques or by sterolithographic techniques. In the illustrated embodiment, a radio frequency (RF) antenna 20 (e.g., an RF antenna board) is integrated into frame 12. RF antenna 20 detects locally-generated RF signals indicative of one or more types of dive information. In accordance in the illustrated embodiment, a breathing apparatus 100 worn by the diver, could have a sensor 22 coupled thereto for sensing critical information about breathing apparatus 100. For example, if breathing apparatus 100 included a compressed air tank (or other pressurized gas flask as used in rebreather types of breathing apparatus), sensor 22 and be a pressure sensor. Sensor 22 provides its output to an RF transmitter 24 that transmits an RF signal 26 that can be detected by RF antenna 20. As is known in the art, short range transmission of RF signals through the water is possible. Since dive mask 10 and RF transmitter 24 will be close to one another in essentially fixed relative positions, RF communication therebetween will be reliable.

RF signals detected by RF antenna 20 are passed through frame 12 via conductor(s) 28 led through frame 12. Conductor(s) 28 terminate at a pre-programmed controller 30 (e.g., microprocessor) that controls the display of dive information. Selection of various programming options are made by the diver via a single control switch 32 (e.g., a conventional push-push switch). The use of a single user control simplifies use of the present invention as the various functions implemented by control switch 32 are embedded in the programming of controller 30. Control switch 32 is coupled to controller 30 via conductor(s) 34 led through frame 12.

While information about the diver's breathing apparatus 100 is critical, it is not the only relevant information that a diver wants to monitor. Specifically, in the illustrated embodiment, controller 30 includes a timer or a software-controlled timer function that can be activated by the diver at the start of a dive to track the amount of time that a diver is underwater. This time lapse is referred to in the art as "bottom time".

In addition to breathing apparatus information and bottom time, a diver needs to monitor his depth in the water. This is accomplished in the present invention, by the integration of depth sensor 36 into frame 12. Water at depth pressure comes into contact with depth sensor 36 via a port 38 formed in frame 12. The signal indicative of depth generated by depth sensor 36 is passed to controller 30 via conductor(s) 40 led through frame 12.

As described above, controller 30 collects or generates signals indicative of the relevant status of breathing apparatus 100, bottom time of the dive, and depth of the diver. These signals are appropriately processed for use by a display in a manner well understood in the art. In the present invention, display signals generated by controller 30 are passed over conductor(s) 42 (led through frame 12) to a directly-viewable display referenced generally by numeral 50. As used herein, the term "directly-viewable" means that the diver will view the display itself as opposed to a reflection thereof thereby eliminating display alignment issues.

Figure 2:
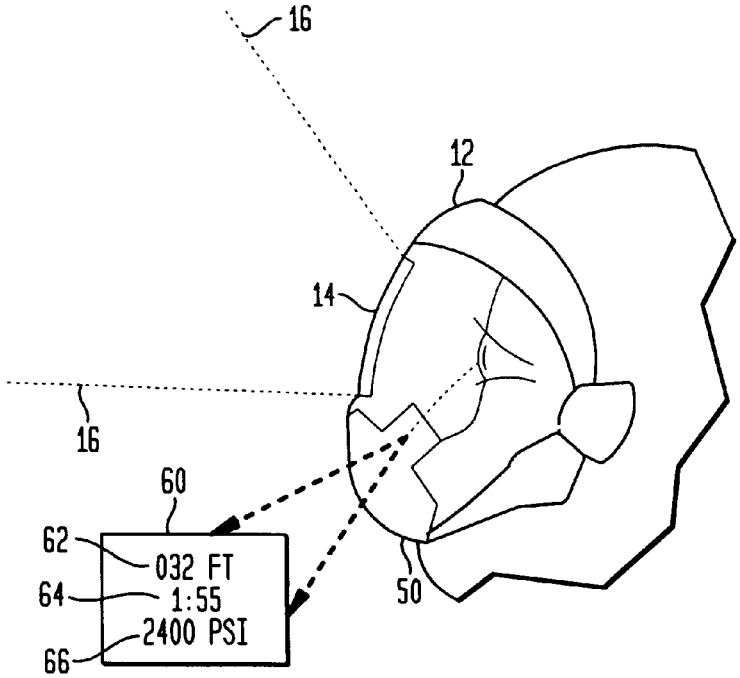
FIG. 2 is a side schematic view of a diver illustrating the diver's unobstructed field of view through the dive mask's lens and the virtual images appearing in the diver's lower peripheral vision outside of the field of view in accordance with the present invention.

Similar to the previously described components, display 50 is integrated in frame 12 so that it is completely protected thereby. Display 50 is located in a peripheral vision area of the diver. Preferably, display 50 is located in a lower portion of the diver's peripheral vision area as illustrated in FIG. 2. However, regardless of its position in the diver's peripheral vision area, display 50 is always positioned outside the field of view (between dashed lines 16) of lens 14. In this way, the diver will always have an unobstructed field of view 16.

Display 50 is constructed to provide a sufficiently large virtual display image that will be easily discerned by user's having a wide range of visual acuity and in all lighting conditions. In the illustrated embodiment, display 50 has a liquid crystal display (LCD) element. 52 that receives display signals from controller 30. LCD element 52 can be either a transmissive LCD or a transflective LCD. LCD element 52 is back lit by a light source 54 that can be powered via controller 30. A three-element lens 56 or triplet lens as it is known, is positioned adjacent (i.e., in. front of) LCD element 52 to provide even magnification thereacross. That is, triplet lens 56 magnifies all portions of LCD element 52 evenly so that no portion thereof is distorted relative to another portion thereof.

With dive mask 10 configured as described above, a virtual image 60 will be directly-viewable by the diver as illustrated in FIG. 2. Virtual image 60 includes a display of diver depth at 62, bottom time of the diver at 64, and pressure of the diver's air/gas tank at 66. While each type of dive information is displayed in a numeric format, the dive information could also be displayed in alternative or additional formats such as a graphical format. Each type of dive information could be flashed on and off (as controlled by controller 30) if they are indicative of dangerous situations.

Power for each component embedded in frame 12 can be self-contained on each component. More typically, power for each component requiring power can be provided by a replaceable power source such as a battery 70 housed in a compartment 72 formed in frame 12. Compartment 72 is accessible/sealable via a plug 74. Power is transferred to the necessary components via conductor(s) 76 and the other conductors described above.

The advantages of the present invention are numerous. The dive mask provides a diver with a directly-viewable display of critical dive information without obstructing any portion of the diver's field of view defined by the dive mask's lens(es). The information appears on a backlit display and is therefore visible regardless of surrounding water visibility. Since all components are embedded in the frame of the dive mask, the components are well protected. A single user control simplifies operation of the system.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A dive mask display system for use in monitoring dive information, comprising:

a dive mask having at least one lens defining a field of view and a frame supporting said at least one lens, said frame interfacing with the face of a diver; and a plurality of components integrated in said frame, said plurality of components including a radio frequency (RF) antenna for receiving RF signals indicative of dive information, a display directly viewable in a peripheral vision area of said diver outside of said field of view, a controller coupled to said RF antenna and said display for processing said RF signals in accordance with predetermined programming options to generate an output, and an input device coupled to said controller for selecting one of said predetermined programming options, wherein said output associated therewith is passed to said display and wherein said output is displayed visually on said display.

2. A dive mask display system as in claim 1, wherein said plurality of components further include a replaceable power source for supplying required power to all others of said plurality of components.

3. A dive mask display system as in claim 1, wherein said plurality of components further include a depth sensor coupled to said controller.

4. A dive mask display system as in claim 1, wherein said controller includes timing means actuated by said input device, said timing means generating a signal indicative of an amount of time lapsed since actuation of said timing means, wherein said signal is displayed visually on said display.

5. A dive mask display system as in claim 1, wherein said display comprises a stacked combination of a magnifying lens for providing even magnification thereacross, a liquid crystal display (LCD) positioned adjacent said magnifying lens for magnification thereby, and a light source for backlighting said LCD.

6. A dive mask display system as in claim 5, wherein said LCD is selected from the group consisting of a transmissive LCD and a transflective LCD.

7. A dive mask display system as in claim 1, wherein said display is located in a lower portion of said peripheral vision area.

8. A dive mask display system for use in monitoring dive information, comprising:

at least one sensor for monitoring dive information associated with a diver;

an RF transmitter coupled to said at least one sensor for generating RF signals indicative of said dive information so-monitored;

a dive mask having at least one lens defining a field of view and a frame supporting said at least one lens, said frame interfacing with the face of said diver; and a plurality of components integrated in said frame, said plurality of components including a radio frequency (RF) antenna for receiving said RF signals, a display directly viewable in a peripheral vision area of said diver outside of said field of view, a controller coupled to said RF antenna and said display for processing said RF signals in accordance with predetermined programming options to generate an output, and an input device coupled to said controller for selecting one of said predetermined programming options, wherein said output associated therewith is passed to said display and wherein said output is displayed visually on said display.

9. A dive mask display system as in claim 8, wherein said plurality of components further include a replaceable power source for supplying required power to all others of said plurality of components.

10. A dive mask display system as in claim 8, wherein said plurality of components further include a depth sensor coupled to said controller.

11. A dive mask display system as in claim 8, wherein said controller includes timing means actuated by said input device, said timing means generating a signal indicative of an amount of time lapsed since actuation of said timing means, wherein said signal is displayed visually on said display.

12. A dive mask display system as in claim 8, wherein said display comprises a stacked combination of a magnifying lens for providing even magnification thereacross, a liquid crystal display (LCD) positioned adjacent said magnifying lens for magnification thereby, and a light source for backlighting said LCD.

13. A dive mask display system as in claim 12, wherein said LCD is selected from the group consisting of a transmissive LCD and a transflective LCD.

14. A dive mask display system as in claim 8, wherein said display is located in a lower portion of said peripheral vision area.

15. A dive mask display system for use in monitoring dive information, comprising:

at least one sensor for monitoring a scuba diver's breathable air supply device and for providing a first signal indicative thereof;

an RF transmitter coupled to said at least one sensor for transmitting said first signal as an RF signal;

a dive mask having at least one lens defining a field of view and a frame supporting said at least one lens, said frame interfacing with the face of said scuba diver; and a plurality of components distributed about and within said frame, said plurality of components including a radio frequency (RF) antenna for receiving said RF signal, a display directly viewable in a peripheral vision area of said scuba diver outside of said field of view, a sensor for monitoring water depth and for providing a second signal indicative thereof, a diver-controlled controller coupled to said RF antenna, said display and said sensor, said diver-controlled controller including timing means actuated by said scuba diver for tracking an amount of time lapsed since actuation of said timing means and for providing a third signal indicative thereof, said diver-controlled controller supplying said first signal, said second signal and said third signal to said display for simultaneous display thereof in a format that can be interpreted by said scuba diver.

16. A dive mask display system as in claim 15, wherein said plurality of components further include a replaceable power source for supplying required power to all others of said plurality of components.

17. A dive mask display system as in claim 15, wherein said display comprises a stacked combination of a magnifying triplet lens for providing even magnification thereacross, a liquid crystal display (LCD) positioned adjacent said magnifying triplet lens for magnification thereby, and a light source for backlighting said LCD.

18. A dive mask display system as in claim 17, wherein said LCD is selected from the group consisting of a transmissive LCD and a transflective LCD.

19. A dive mask display system as in claim 15, wherein said display is located in a lower portion of said peripheral vision area.

20. A dive mask display system as in claim 15, wherein said format is a numeric format.

* * * * *

UNITED STATES PATENT AND TRADEMARK OFFICE
Certificate

Patent No. 6,447,115 B1 Patented: September 10, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Dennis Gallagher, Panama City, FL; William Olstad, Panama City, FL; Charles Holmes, Panama City, FL; William Hughes, Lynn Haven, FL, and Robert Hollis, San Leandro, CA.

Signed and Sealed this Twenty-fifth Day of October 2005.

GEORGIA Y. EPPS
*Supervisory Patent Examiner*
Art Unit 2873